United States Patent [19]

Miller

[11] Patent Number: 4,659,122

[45] Date of Patent: Apr. 21, 1987

[54] AUTOMOBILE TRUNK TIE-DOWN

[76] Inventor: David H. A. Miller, 28 S. Linden Dr., Orlando, Fla. 32807

[21] Appl. No.: 855,952

[22] Filed: Apr. 25, 1986

[51] Int. Cl.[4] ..... E05C 17/36

[52] U.S. Cl. ..... 292/262; 242/86.5 R

[58] Field of Search ..... 292/262, 264, 277, 278, 292/266, 267; 242/86.5 R

[56] References Cited

U.S. PATENT DOCUMENTS

| | | | |
|---|---|---|---|
| 890,518 | 6/1908 | Kleidmann | 292/264 |
| 1,987,913 | 1/1935 | Schuly | 292/264 |
| 2,217,079 | 10/1940 | Ronning | 292/262 |
| 2,803,899 | 8/1957 | Denovan | 292/264 X |
| 2,873,992 | 2/1959 | McCaughan | 292/262 |
| 3,893,709 | 7/1975 | Gertler, Jr. | 242/86.5 R X |
| 4,191,413 | 3/1980 | Barner | 292/262 |
| 4,493,500 | 1/1985 | Stroup | 292/262 |

*Primary Examiner*—Richard E. Moore

*Attorney, Agent, or Firm*—Elsie T. Apthorp

[57] ABSTRACT

An automobile trunk tie-down is constructed of a flexible strand provided with a plurality of eyelets disposed at intervals throughout its length to receive hooks mounted inside the trunk compartment and lid, so that varying lengths of strand may be selected depending upon the size of the object being transported in the automobile trunk which prevents the lid from closing over it. Automatic storage of the tie-down is provided by means of a conventional retracting reel permanently mounted within the trunk.

6 Claims, 7 Drawing Figures

AUTOMOBILE TRUNK TIE-DOWN

BACKGROUND OF THE INVENTION

1. Field of the Invention

The invention relates to a tie-down, particularly a te down for securing the trunk lid of an automobile over a bulky object transported in the trunk when the lid cannot be shut.

Heretofore, in order to secure a trunk lid over a bulky object in the trunk, it has been necessary to use rope or twine tied in some fashion at one end to the trunk lid and at the other to the frame of the automobile. Sometimes it is difficult to find a suitable anchoring point at which to fasten the rope or twine. Thus the process of securing the trunk lid is usually time-consuming. Upon removal of the object, it is necessary to unfasten the rope or twine, which is also time-consuming. To avoid this step, the user will usually cut lightweight twine. This results in at least partial loss of twine and fails to eliminate the need for untying the twine at some later time. Further, if the rope or twine is carried in the automobile at all times so that it will always be available, it could become tangled and could roll into crevices, involving more time and trouble, unless it is appropriately stowed.

Accordingly, it is an object of this invention to provide a simple, inexpensive reusable tie down for a trunk lid which is easily and quickly fastened and unfastened.

Another object of the invention is to provide for permanent mounting of the invention at the point where it will be used.

It is also desired to provide for convenient and automatic storage of the tie down inside the trunk when not in use.

2. Prior Art

A review of the prior art in the field of this invention shows various retractable fasteners for use with motor vehicles. Retractable tape measures are commonplace. Also well-known are retractable electric cords on appliances. A motor-driven retractable seat belt mechanism is disclosed in U.S. Pat. No. 3,182,923 to Botar. This is a complicated device employed many machined metal parts and gears. It does not relate to transporting bulky objects in an auto trunk.

U.S. Pat. No. 3,893,709 to Gertler relates to a towing device for extricating a motorcycle, involving a length of cable stored on a spool mounted on the cycle. A large hook attached to the free end of the cable for attachment to a towing vehicle.

U.S. Pat. No. 1,374,556 to Dunn relates to a device for carrying tire chains near the wheels of a vehicle and for easy attachment to the wheels, involving the application of tension to the chains.

U.S. Pat. No. 4,288,188 to Smith discloses a tie down for securing objects carried on the roof of an automobile. The tie-down is self-supporting and can be mounted on the outside of the vehicle. One use depicted in the drawings shows a pair of tie downs anchored within the rain gutters of the side walls of the trunk. One end of each tie-down is anchored to the vehicle, and the other end is fitted with a loop. In order to secure an object being transported, it is necessary to use some cord or rope in addition to the tie-downs. The rope is wrapped about the object and then secured to the loops at the free ends of the tie-downs. No means are provided for varying the length of the working part of the tie-down. Furthermore, this system does not obviate the use of additional rope or twine.

SUMMARY OF THE INVENTION

An automobile trunk tie-down is constructed of a flexible strand provided with a plurality of eyelets disposed at intervals throughout its length to receive hooks mounted inside the trunk compartment and lid, so that varying lengths of strand may be selected depending upon the size of the object being transported in the auto trunk which prevents the lid from closing over it. Automatic storage of the tie-down is provided by means of a conventional retracting reel permanently mounted within the trunk.

DETAILED DESCRIPTION OF THE DRAWINGS

Figure 1:
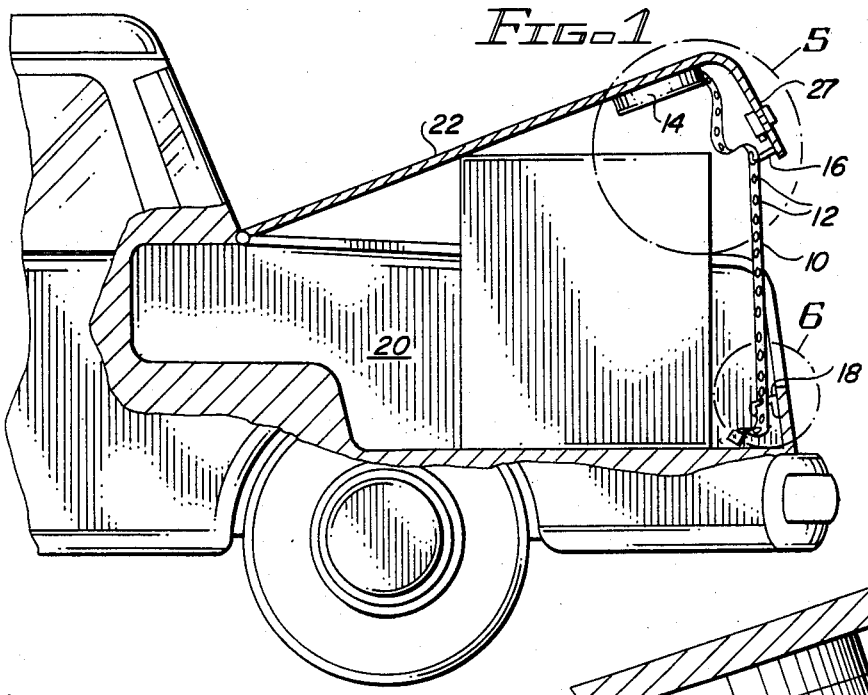
FIG. 1 is a sectional view of an automobile trunk showing the tie-down in use, the retracting reel and standing part of the strand attached to the inside of the trunk lid, and the bitter end of the strand hooked to the inside of the rear wall of the trunk.
Figure 5:
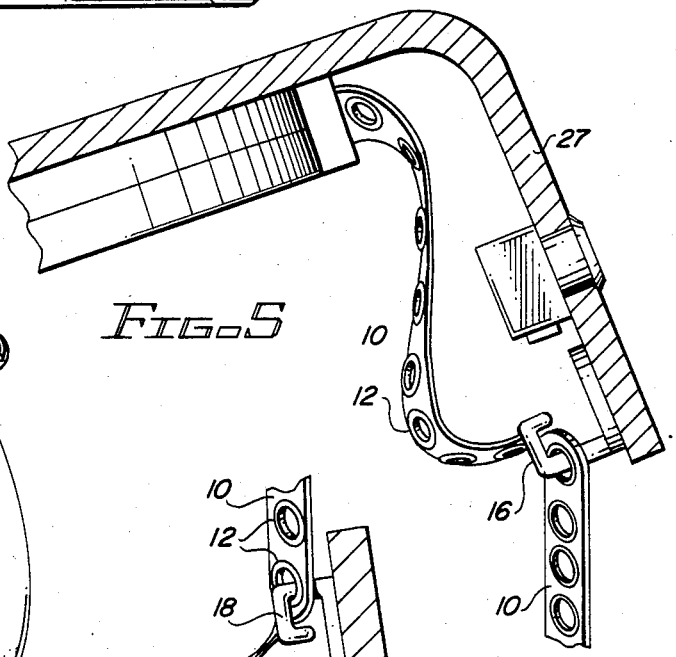
FIG. 5 is a detail view of that portion of FIG. 1 enclosed in circle 5.
Figure 6:
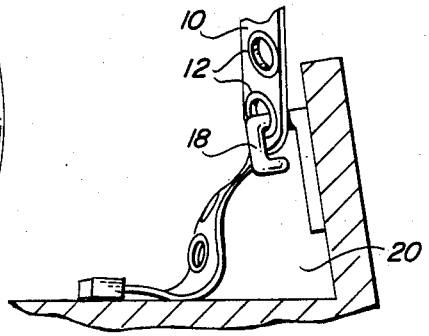
FIG. 6 is a detail view of that portion of FIG. 1 enclosed in circle 6.
Figure 3:
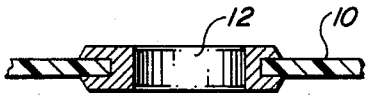
FIG. 3 is a sectional view taken on line 3—3 of FIG. 2.

Referring to FIG. 1, the auto trunk tie-down for securing an auto trunk lid 22 over a bulky item within the trunk 20 which prevents the lid 22 from being closed, employs a flexible strand 10 of length sufficient to reach from the distal end of trunk lid 22, when fully opened, to a hook 18 mounted on the inside of the rear wall of the automobile trunk compartment 22, and preferably, to reach around any bulky item placed within the trunk compartment 20 that might protrude horizontally beyond the rear wall thereof. The flexible strand 10 could be made of any strong, flexible material, such as plastic pipe strap, metal chain or cable, or nylon braid. I prefer to use flat nylon braid, nylon for its strength plus stretch, and a flat configuration for its compactness when coiled and amenability to accepting grommets. The strand is equipped with a plurality of eyelets 12 which may be reinforced with metal or plastic grommets, which are indicated in FIGS. 2, 3, 5 and 6. The eyelets should be numerous enough to permit varying lengths of the strand to be secured at the standing or reel end by engagement with hook 16 mounted on the inside of the distal end of the trunk lid, as shown in FIG. 5, and at the free or bitter end by hook 18 mounted on the inside of the rear wall of the trunk compartment, as shown in FIG. 6.

Figure 2:
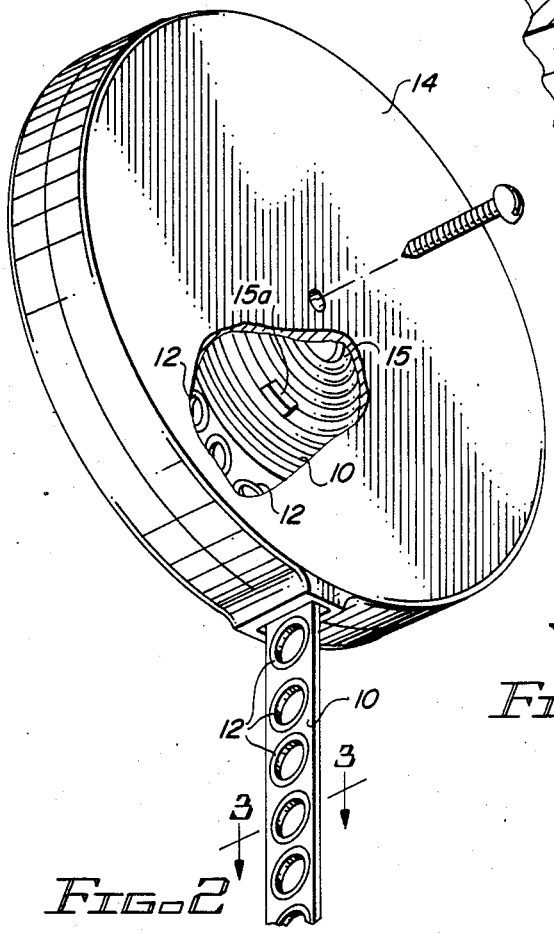
FIG. 2 is an enlarged view of reel and strand showing a plurality of eyelets perforating the strand, and a cutaway view of the reel housing showing the spiral spring equipped with a stop at its junction with the strand to prevent to prevent extension of the spring outside the reel housing.

The strand is storred on a conventional, enclosed, spring-operated retracting reel 14, equipped with a spiral spring 15, as shown in FIG. 2. Spring 15 may be equipped with a stop 15*a* at its junction with strand 10 to protect it from extension beyond the opening where the strand exits the reel housing. Strand 10 should be fitted with a stop at its free end to prevent the end from retracting inside the reel housing where it would be virtually inaccessible. Retracting reel 14 may be mounted to the inside of trunk lid 22, preferably in the center of the lip 27 thereof, by any conventional means. A machine screw is shown in FIG. 2, but rivets would serve as well.

Figure 4:
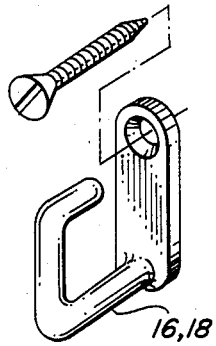
FIG. 4 is a perspective view of either of two hooks, together with a mounting screw, that are shown in place in FIGS. 1, 5, 6 and 7.

Hooks 16 and 18 are conventional and may be mounted by conventional means. A machine screw is shown in FIG. 4, but rivets could be used instead. Hook 16 is preferably mounted on trunk lid lip 27 near the point of exit of strand 10 from reel 14, and serves to lock the unwound length of strand 10 against retraction onto the reel, and against further unwinding due to forces operating on trunk lid 22. Hook 18 is preferably mounted inside the rear wall of trunk compartment 20 at or near the center thereof, for securing the bitter end of strand 10 by engagement in an eyelet 12.

Figure 7:
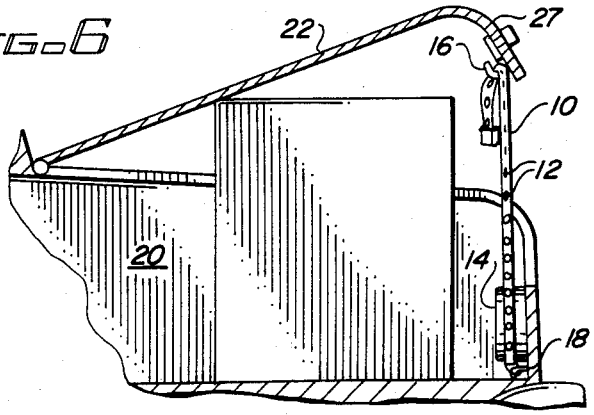
FIG. 7 is a sectional view, similar to FIG. 1, of an auto trunk showing an alternative placement of the reel and standing part of the strand on the inside of the rear trunk wall, and the hook for attaching the bitter end of the strand on the inside of the trunk lid.

An alternative configuration of the elements of my invention illustrated in FIG. 7 involves placement of the retracting reel 14 on the inside of the rear wall of trunk compartment 20, and the bitter end of strand 10 engaged by hook 16 inside trunk lid lip 27.

I claim:

1. An automobile trunk-lid tie-down comprising:

a retracting reel device fastened to an automobile trunk lid;

a flexible strand with one end attached to said reel for rolled retraction thereon;

means for attaching the free end of said strand to the trunk compartment of said automobile; and means for locking an unrolled length of said strand against retraction onto said reel and against further unrolling from said reel.

2. An auto trunk-lid tie-down according to claim 1 wherein said flexible strand is perforated with a plurality of eyelets; and said means for attaching the free end of said strand comprises a first hook member fastened to said auto trunk compartment for removable insertion into one of said eyelets at the free end of said strand.

3. An automobile trunk-lid tie-down according to claim 2 wherein said means for locking said unrolled length of strand against retraction and against further unrolling comprises a second hook member fastened to said trunk lid, said hook for removable insertion in another of said eyelets at a selected distance from said free end of said strand.

4. An automobile trunk-lid tie-down according to claim 3 wherein said flexible strand is made of flat nylon braid.

5. An automobile trunk-lid tie-down according to claim 4 wherein said eyelets perforating said flexible strand are reinforced with metal grommets.

6. An automobile trunk-lid tie-down comprising:

a retracting reel member fastened to an automobile trunk compartment;

a flexible strand with one end attached to said reel for rolled retraction thereon;

means for attaching the free end of said strand to the trunk lid of said automobile; and means for locking an unrolled length of said strand against retraction onto said reel and against further unrolling from said reel.

* * * * *